US007341039B1

(12) United States Patent
Jaszewski et al.

(10) Patent No.: US 7,341,039 B1
(45) Date of Patent: Mar. 11, 2008

(54) LUBRICATION SYSTEM FOR A MARINE PROPULSION SYSTEM WITH A TILTED IN-LINE ENGINE

(75) Inventors: Wayne M. Jaszewski, Jackson, WI (US); Joshua K. English, Stillwater, OK (US); George E. Phillips, Oshkosh, WI (US); Brian D. Simpson, Yale, OK (US)

(73) Assignee: Brunswick Corporation, Lake Forest, IL (US)

( * ) Notice: Subject to any disclaimer, the term of this patent is extended or adjusted under 35 U.S.C. 154(b) by 16 days.

(21) Appl. No.: 11/432,841

(22) Filed: May 12, 2006

(51) Int. Cl.
*F02F 7/00* (2006.01)

(52) U.S. Cl. ..... 123/196 R; 123/195 AC; 123/195 C

(58) Field of Classification Search ..... 123/196 R, 123/195 P, 198 DA, 198 E, 195 C, 195 AC; 440/88 R
See application file for complete search history.

(56) References Cited

U.S. PATENT DOCUMENTS

| | | | | |
|---|---|---|---|---|
| 4,270,497 | A * | 6/1981 | Valerio | 123/195 C |
| 4,519,348 | A | 5/1985 | Hamilton | 123/195 C |
| 4,938,184 | A * | 7/1990 | Martin et al. | 123/195 C |
| 5,016,584 | A * | 5/1991 | Inoue et al. | 123/195 R |
| 5,038,890 | A * | 8/1991 | Tanaka et al. | 184/6.5 |
| 5,092,291 | A * | 3/1992 | Langlois | 123/196 R |
| 5,103,782 | A * | 4/1992 | Matsui | 123/195 C |
| 5,209,285 | A * | 5/1993 | Joshi | 165/41 |
| 5,257,674 | A * | 11/1993 | Okui et al. | 180/297 |
| 5,465,692 | A * | 11/1995 | Uraki et al. | 123/195 C |
| 5,852,991 | A * | 12/1998 | Yamamura et al. | 123/195 C |
| 5,960,763 | A * | 10/1999 | Yamamura | 123/195 C |
| 6,019,071 | A * | 2/2000 | Maciejka, Jr. | 123/41.35 |
| 6,530,354 | B1 * | 3/2003 | Bishop et al. | 123/195 C |
| 6,564,905 | B1 * | 5/2003 | Yukioka | 184/6.28 |
| 6,568,509 | B1 * | 5/2003 | Sugiura | 184/106 |
| 6,591,819 | B2 * | 7/2003 | Tscherne et al. | 123/572 |
| 6,874,460 | B2 * | 4/2005 | Duwel | 123/196 R |
| 6,889,651 | B2 * | 5/2005 | Tanaka et al. | 123/196 R |
| 6,941,923 | B2 * | 9/2005 | Saito | 123/196 R |
| 7,014,519 | B1 * | 3/2006 | Batten et al. | 440/38 |
| 7,086,370 | B2 * | 8/2006 | Yonezawa et al. | 123/195 P |
| 7,128,027 | B1 * | 10/2006 | Straub et al. | 123/41.33 |
| 2003/0029412 | A1 * | 2/2003 | Kato et al. | 123/195 C |
| 2004/0118373 | A1 * | 6/2004 | Gesell et al. | 123/196 R |
| 2005/0268878 | A1 * | 12/2005 | Ito | 123/196 R |

* cited by examiner

*Primary Examiner*—Hai Huynh
(74) *Attorney, Agent, or Firm*—William D. Lanyi

(57) ABSTRACT

A lubrication system for an in-line engine which has a piston symmetry plane that is tilted relative to a vertical plane is provided with an oil pan and windage tray that facilitates the transfer of oil from a rotating crankshaft to the oil pan without excessive aeration. In addition, it facilitates the removal of entrained air from liquid oil as it passes from the crankshaft to a pool of oil collected in an oil pan. A windage tray is provided with a louver structure and a louver opening structure that assists this passage of oil droplets without undue aeration being caused.

15 Claims, 6 Drawing Sheets

LUBRICATION SYSTEM FOR A MARINE PROPULSION SYSTEM WITH A TILTED IN-LINE ENGINE

BACKGROUND OF THE INVENTION

1. Field of the Invention

The present invention is generally related to a lubrication system for a marine engine and, more particularly, to an oil pan and windage tray for a marine engine that is tilted to lower its overall height.

2. Description of the Related Art

Many different types of marine propulsion systems are known to those skilled in the art. One type of sterndrive propulsion system is known which incorporates a tilted in-line engine which lowers the profile of the engine and facilitates its use in certain types of marine vessels, such as bass boats, which heretofore were not amenable to the use of sterndrive propulsion systems.

U.S. Pat. No. 4,519,348, which issued to Hamilton on May 28, 1985, describes an oil pan and windage tray for high performance engines which reduce friction loss by separating the oil collection volume of the pan from rotating engine components. A skimmer integral with the tray skims oil from rotating parts and channels oil thrown from the rotating parts into a side pouch of the pan for delivery to the pan collection volume. The skimmer and tray mount to the engine separately from the pan. An alternate embodiment of a dry sump pan has a removable partition between a side pouch and the rotating parts and a skimmer separate from the pan.

U.S. Pat. No. 6,019,071, which issued to Maciejka on Feb. 1, 2000, describes an engine windage tray. The windage tray is positioned between the crankshaft and the oil pan. It includes a passage having an inlet port receiving the pressurized oil and a first outlet port directing a first stream of the pressurized oil at the piston. In a preferred embodiment, the passage further includes a second outlet port directing a second stream of pressurized oil at the piston.

U.S. Pat. No. 6,530,354, which issued to Bishop et al. on Mar. 11, 2003, describes an oil pan with vertical baffles. The oil pan is intended for use with an engine having a crankshaft and includes a pan body adapted to be disposed beneath the crankshaft for receiving oil that is exhausted from the engine. The oil pan further includes a vertically extending baffle attached to the pan body.

U.S. Pat. No. 6,874,460, which issued to Duwel on Apr. 5, 2005, describes an integrated oil pan and windage tray. The tray is adapted for installation between the engine block and the oil pan and the tray has a body with a peripheral flange extending about the periphery of the body and at least one deflector portion extending away from the body to a location spaced away from the peripheral flange.

U.S. Pat. No. 7,014,519, which issued to Batten et al. on Mar. 21, 2006, discloses a marine propulsion system with a tilted in-line engine. The engine is disposed at a tilted angle relative to a vertical plane in order to reduce the maximum height requirement space of an engine compartment of a marine vessel. The crankshaft axis of the in-line engine can be located on a vertical vessel symmetry plane or can be offset from it. The crankshaft of the in-line engine can be disposed parallel to the vessel symmetry plane, within the vessel symmetry plane, or perpendicular to the vessel symmetry plane.

The patents described above are hereby expressly incorporated by reference in the description of the present invention.

When a marine engine is tilted, as disclosed in U.S. Pat. No. 7,014,519, the physical relationships between the crankshaft of the engine and the liquid oil within the oil sump portion of an oil pan are changed. These physical relationships can result in certain disadvantageous conditions, such as aeration of the liquid oil within the oil pan. If a significant amount of air is suspended within the liquid oil in the oil reservoir of the engine, the lubricity of the oil can be degraded sufficiently to adversely affect the wear of various sliding engine parts. It would therefore be significantly beneficial if an oil storage and collection system of a tilted in-line marine engine could be provided with an arrangement that decreases the aeration of oil stored within the lubrication system while also decreasing the adverse efficiency effect caused by a mist of oil vapor and droplets in the vicinity of rotating components of the engine, such as the crankshaft, connecting rods, and counterweights.

SUMMARY OF THE INVENTION

A lubrication system for an engine of a marine vessel, made in accordance with a preferred embodiment of the present invention, comprises an internal combustion engine having all of its cylinders aligned in a piston symmetry plane. The piston symmetry plane is disposed at a tilt angle from a vertical plane. The tilt angle is preferably between fifteen and seventy five degrees and the engine has a crankshaft which is disposed within a crankcase and also disposed within the piston symmetry and vertical planes. An oil pan, in a preferred embodiment of the present invention, is attached to the internal combustion engine. The oil pan and the crankcase define an internal cavity. The oil pan is shaped to contain a quantity of liquid oil having an upper oil surface. A windage tray is disposed within the internal cavity. The windage tray has a louver structure formed through a surface thereof. The louver structure is formed to define a louver opening structure therethrough. The louver structure is configured to inhibit droplets of oil from having a direct linear path through the louver opening structure from the crankshaft to the upper oil surface.

The oil pan has an internal wall surface which is disposed above the upper oil surface during normal operation of the internal combustion engine. The louver structure is configured to define a direct path through the louver opening structure from the crankshaft to the internal wall surface disposed above the upper oil surface.

The oil pan is attached to the internal combustion engine along an attachment surface which is generally perpendicular to the piston symmetry plane. The lowest point of the attachment surface is disposed above the upper oil surface in a particularly preferred embodiment of the present invention. A preferred embodiment of the present invention can further comprise at least one baffle disposed on an internal surface of the oil pan. It can also comprise an oil pick-up conduit disposed in fluid communication with the quantity of liquid oil in the oil pan.

The louver structure can comprise first and second louvers spaced apart from each other and the louver opening structure can comprise first and second louver openings. The first and second louver openings are unequal in effective area in a particularly preferred embodiment of the present invention. The first louver opening is larger in effective area than the second louver opening. The internal wall surface is generally parallel to the piston symmetry plane in a particularly preferred embodiment of the present invention.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
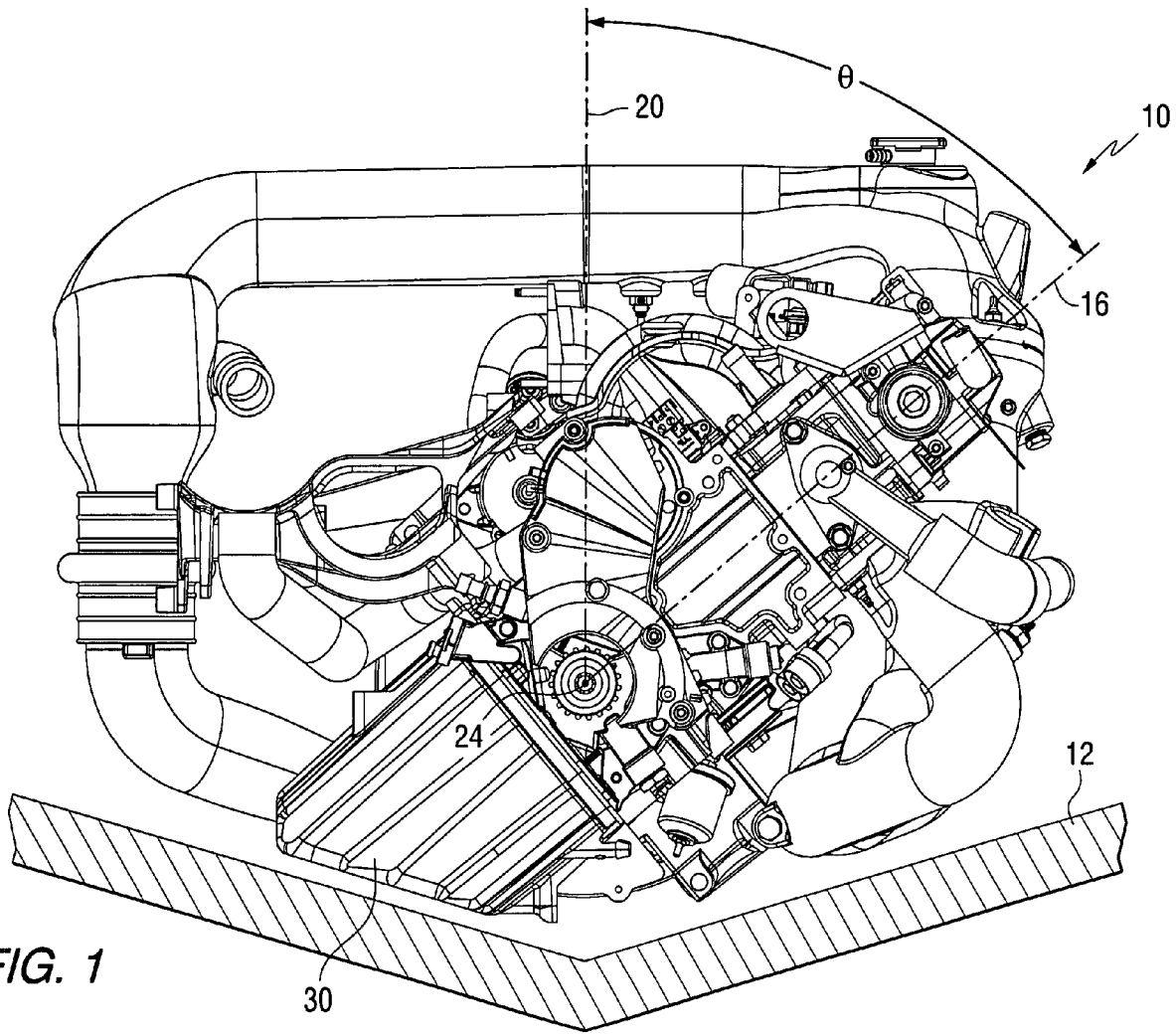
FIG. 1 is a front view of a tilted in-line marine engine.

Throughout the description of the preferred embodiment of the present invention, like components will be identified by like reference numerals.

FIG. 1 is a front view of a marine propulsion engine 10 which is configured as a tilted in-line engine. The basic concept of the tilted in-line engine is generally similar to that which is disclosed in U.S. Pat. No. 7,014,519. It should be understood that the engine 10 can be tilted either toward port or is starboard in various embodiments of the concept disclosed in U.S. Pat. No. 7,014,519 and herein.

The engine in FIG. 1 is shown relative to a bottom portion 12 of a marine vessel. The front view in FIG. 1 shows the engine 10 with its piston symmetry plane 16 tilted toward the port side of the marine vessel. All of the cylinders of the engine 10 are aligned in the piston symmetry plane 16 which, as illustrated in FIG. 1, is disposed at a tilt angle θ from a vertical plane 20. The tilt angle θ is between fifteen and seventy five degrees in a particularly preferred embodiment of the present invention. The engine 10 has a crankshaft which is rotatable about the crankshaft axis 24. The crankshaft, which will be described in greater detail below, is disposed within a crankcase and also disposed within the piston symmetry and vertical planes, 16 and 20. An oil pan 30 is attached to the internal combustion engine 10. The oil pan 30 and crankcase define an internal cavity, which will be described in greater detail below. The oil pan 30 is shaped to contain a quantity of liquid oil having an upper oil surface.

Figure 2:
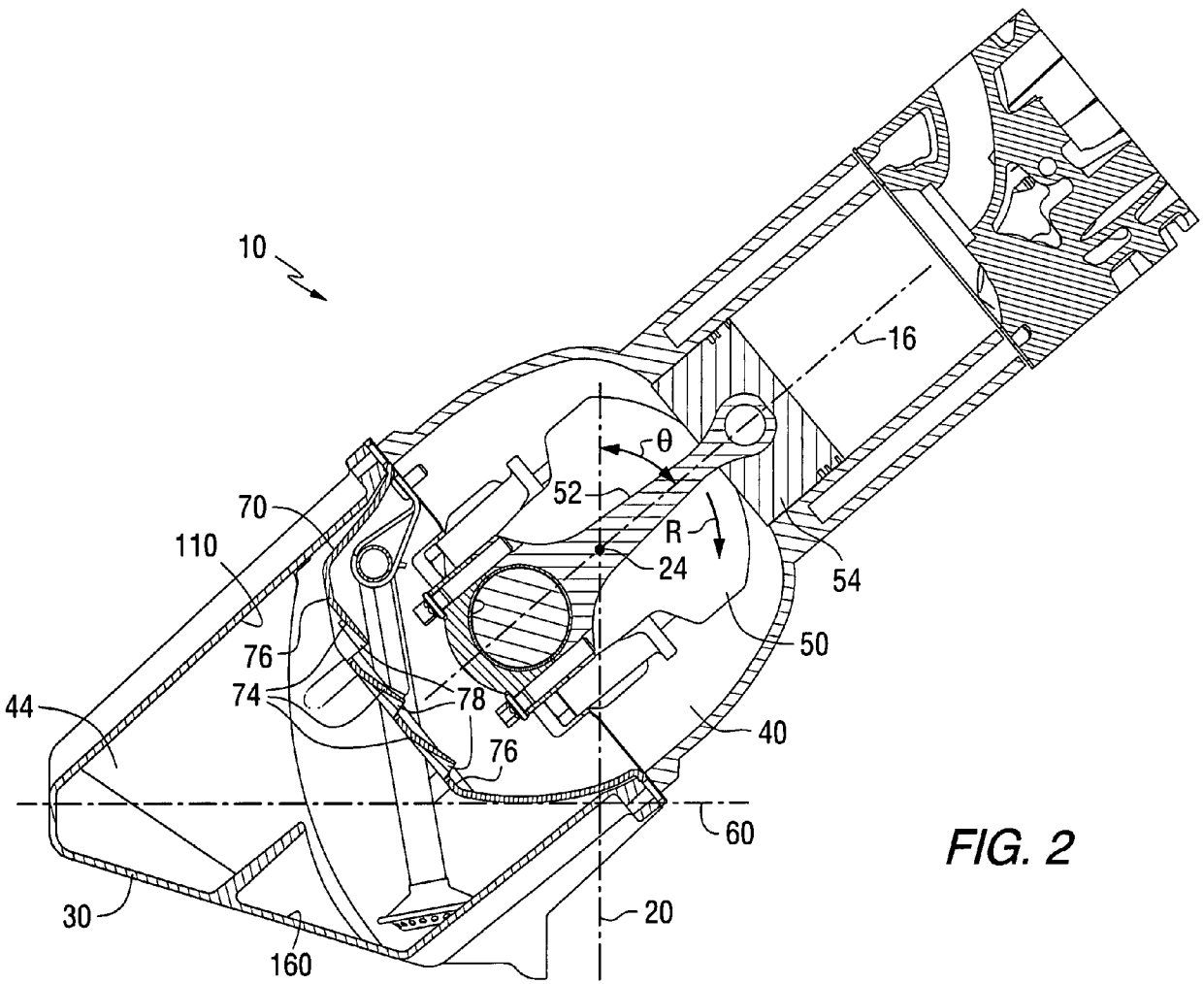
FIG. 2 is a section view of the engine shown in FIG. 1.

FIG. 2 is a section view taken through the engine 10 to illustrate the crankcase 40 and the internal space 44 of the oil pan 30 which combine to define the internal cavity of the lubrication system described above. Also shown in FIG. 2 is a counterweight 50 of the crankshaft, which is rotatable about crankshaft axis 24, a connecting rod 52 and a piston 54 which are all shown in an exemplary fashion to illustrate the relative positions of these components of the engine. Arrow R illustrates the direction of rotation of the crankshaft about its axis 24. FIG. 2 also shows the tilt angle θ between the vertical plane 20 and the piston symmetry plane 16. Line 60 illustrates the typical location of an upper oil surface of the liquid oil stored within the oil pan 30. A windage tray 70 is disposed within the internal cavity which comprises cavities 40 and 44. A louver structure 74 is formed through a surface 76 of the windage tray 70. The louver structure 74 is configured to define a louver opening structure 78. The louver structure 74 is also configured to inhibit droplets of oil from having a direct linear path through the louver opening structure 78 from the crankshaft to the upper oil surface 60.

Figure 3:
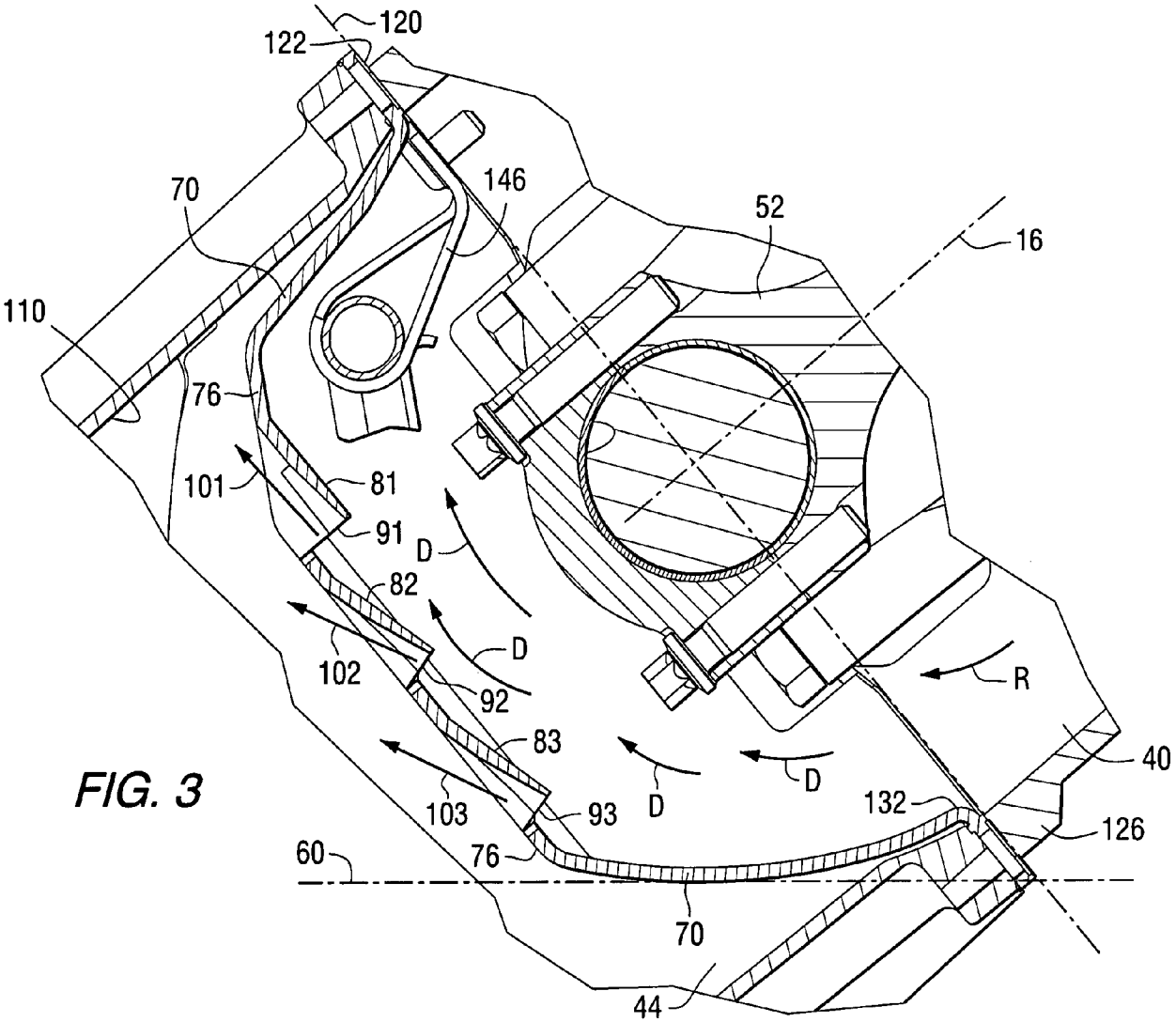
FIG. 3 is an enlarged portion of the illustration in FIG. 2.

FIG. 3 is an enlarged partial view of the illustration shown in FIG. 2. With reference to FIGS. 1-3, the illustration in FIG. 3 is intended to more clearly show the louver structure 74 and louver opening structure 78 illustrated in FIG. 2. Arrows D are intended to illustrate the likely path of the oil mist and droplets that rotate about the crankshaft as a result of the rotation of the crankshaft structure in the direction represented by arrow R. This mist comprises both liquid oil and oil vapor that are carried on the crankshaft components and thrown from the crankshaft structure as a result of the centrifugal forces caused by its rotation.

With continued reference to FIGS. 1-3, the louver structure 74 is illustrated in FIG. 3 as comprising three louvers, 81-83. These louvers are spaced apart from each other to define three louver openings, 91-93. The first louver opening 91 is larger in effective area than the second louver opening 92. Similarly, the second louver opening 92 is larger in effective area than the third louver opening 93. Arrows 101-103 are provided to illustrate the probable path of oil droplets that are allowed to pass through the three louver openings, 91-93. Oil droplets passing in other directions would likely be blocked, or at least inhibited, from passing from the region identified by reference numeral 40 to the region identified by reference numeral 44 in FIG. 2. In other words, to pass through the windage tray 70, the droplets must follow a trajectory that is generally similar to one of the arrows, 101-103.

In FIGS. 2 and 3, reference numeral 110 is used to identify an internal wall surface within the oil pan 30. The internal wall surface 110 is illustrated as being generally parallel to the piston symmetry plane 16. It is the intent of the present invention, in a preferred embodiment, to restrict the flow of oil droplets through the louver opening structure 74 to paths which are likely to cause the droplets to impinge against the internal wall surface 110 above the surface of liquid oil 60. As a result, the oil droplets impinging against the oil wall surface 110 will tend to collect on that wall surface above the upper surface 60 of liquid oil and then flow downwardly under the influence of gravity into the pool of liquid oil at the bottom portion of the oil pan 30. This process will transfer the oil from the crankshaft to the pool of oil in the oil pan 30 in a way that minimizes the aeration of the oil and, in fact, allows entrained air to escape from the liquid oil as it flows downwardly along the inner wall surface 110 toward the upper surface 60 of the oil pool.

With continued reference to FIGS. 1-3, the oil pan 30 is attached to the internal combustion engine 10 along an attachment surface which is identified by line 120 in FIG. 3. It should be understood that the attachment surface of the oil pan 122 is generally perpendicular to the piston symmetry plane 16. In the embodiment of the present invention illustrated specifically in FIGS. 2 and 3, a flange of the windage tray 70 is disposed between parallel attachment surfaces of the oil pan 30 and the crankcase housing 126. The lowest point 132 of this attachment surface 122 of the oil pan 30 is disposed above the upper oil surface 60 of the liquid oil contained within the oil pan 30 in a preferred embodiment of the present invention.

Figure 4:
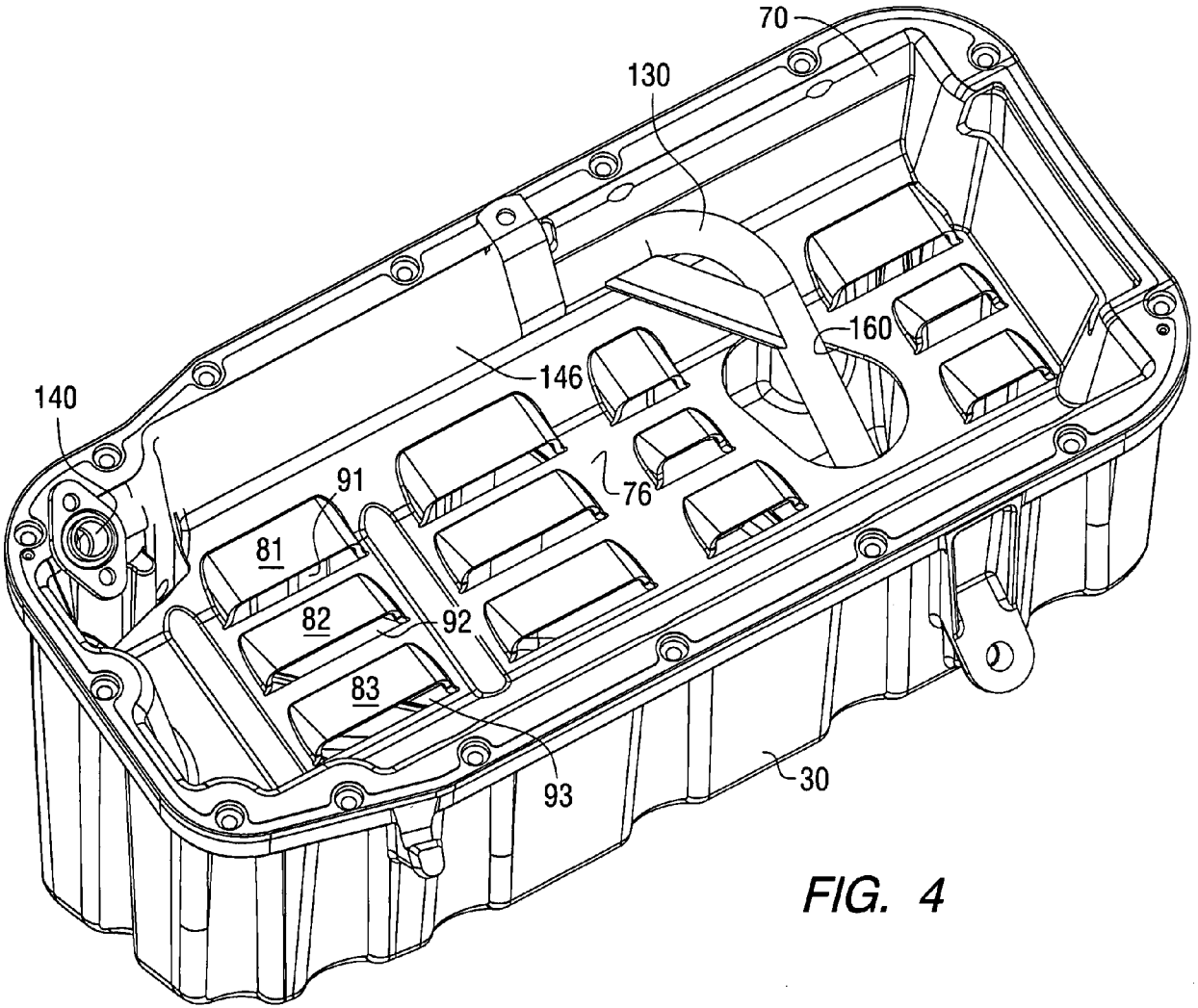
FIG. 4 shows the oil pan, windage tray, and pick-up conduit of a preferred embodiment of the present invention.

FIG. 4 is an isometric view of the oil pan 30, the windage tray 70, and an oil pick-up tube 130. As can be seen, four rows of louvers are shown formed in the surface 76 of the windage tray 70. Each row of louvers is intended to be located proximate the circular path of a connecting rod 52 of the engine. In a four cylinder in-line engine, the overall configuration of louvers would appear as shown in FIG. 4 in a preferred embodiment of the present invention. The varying sizes of the louvers in the different rows in FIG. 4 are a result of spatial considerations which are not directly related to the basic concepts of the present invention. The is pick-up tube 130 has one end (not shown in FIG. 4) disposed within the pool of oil below the upper surface 60 and another end 140 connected in fluid communication with an oil pump which draws oil from the oil pool below the upper surface 60 and causes that oil to flow to various locations where lubrication is needed for the engine. A support structure 146 is provided to support the weight of the pick-up tube 130.

Figure 5:
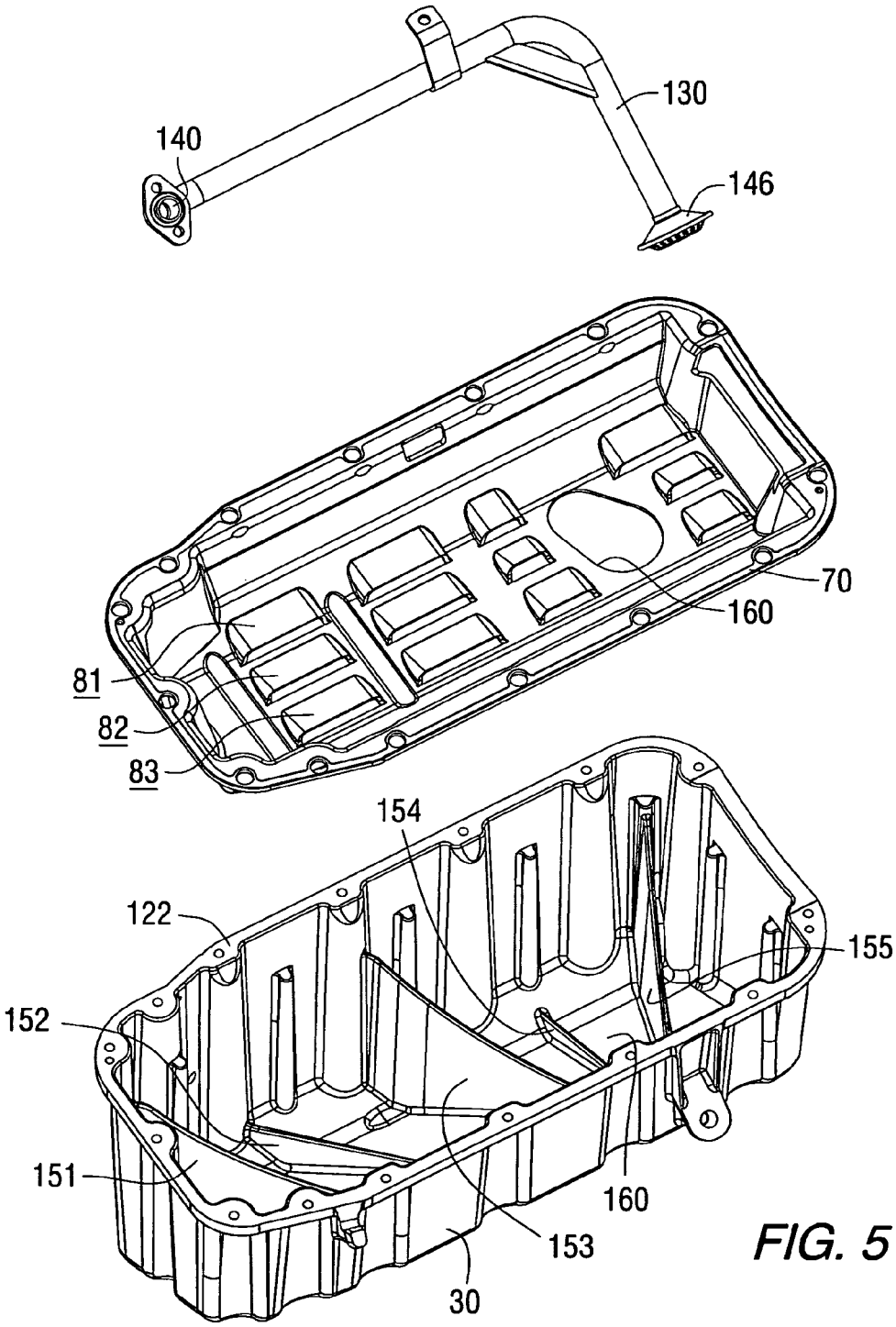
FIG. 5 is an exploded isometric view of the illustration in FIG. 4.

FIG. 5 is an exploded isometric view of the structure shown in FIG. 4. In FIG. 5, a plurality of baffles, 151-155, are disposed on a lower internal surface 160 of the oil pan 30. These baffles direct the flow of liquid oil toward the lower end 146 of the pick-up tube 130. This allows an oil pump to draw the liquid oil from the lowermost portion of the pool of oil within the oil pan 30. The pick-up tube 130 extends through the opening identified by reference numeral 160 in FIG. 5.

With reference to FIGS. 4 and 5, it can be seen that the louvers, 81-83, are configured to result in louver openings, 91-93, of different effective areas. As described above, these louver openings, 91-93, are positioned to direct a flow of oil droplets and mist in the directions identified by reference numerals 101-103 in FIG. 3 and toward the inner wall surface 110 of the oil pan 30.

Figure 6:
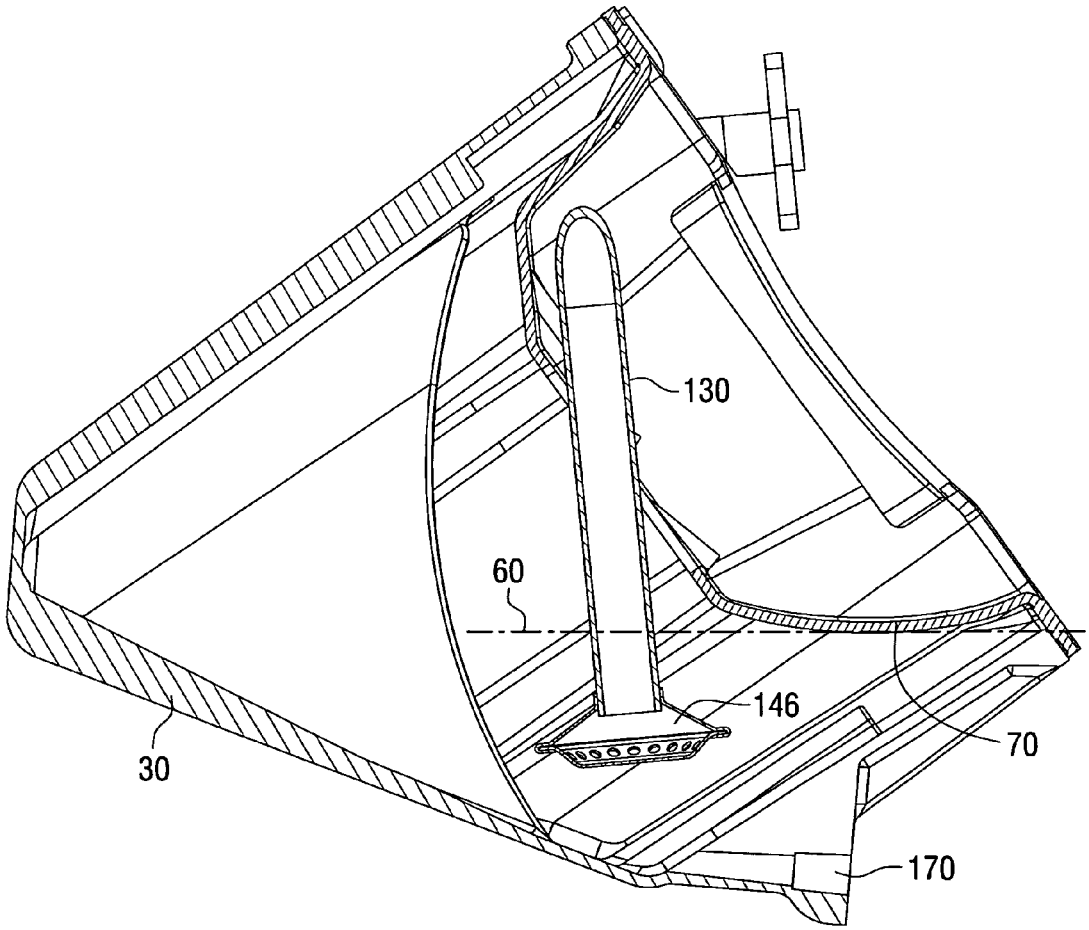
FIG. 6 is an enlarged view of an oil pan and pick-up tube made in accordance with a preferred embodiment of the present invention.

FIG. 6 is an enlarged section view of the oil pan 30 of the present invention, showing the pick-up tube 130 and the position of its end 146 that is disposed within the oil pool below the upper surface 60. FIG. 6 also shows a drain opening 170 that can be used to remove oil from the oil pan 30.

With reference to FIGS. 1-6, it can be seen that a preferred embodiment of the present invention comprises an internal combustion engine 10 having all of its cylinders aligned in a piston symmetry plane 16. The piston symmetry plane 16 is disposed at a tilt angle θ from a vertical plane 20. The tilt angle θ is between fifteen and seventy five degrees in a preferred embodiment of the present invention. The engine 10 has a crankshaft disposed within a crankcase 40 and disposed within the piston symmetry and vertical planes, 16 and 20. An oil pan 30 is attached to the internal combustion engine 10. The oil pan and the crankcase define an internal cavity which is represented by reference numerals 40 and 44 in FIG. 2. The oil pan 30 is shaped to contain a quantity of liquid oil in a pool having an upper oil surface 60. A windage tray 70 is disposed within the internal cavity and has a louver structure 74 formed through a surface 76 thereof. The louver structure 74 is formed to define a louver opening structure 78 therethrough. The louver structure 74 is configured to inhibit droplets, represented by arrows D, of liquid oil from having a direct linear path through the louver opening structure 78 from the crankshaft to the upper oil surface 60. The oil pan 30 has an internal wall surface 110 disposed above the upper oil surface 60 during normal operation of the internal combustion engine 10. The louver structure 74 is configured to define a direct path, represented by arrows 101-103, through the louver opening structure 78 from the crankshaft to the internal wall surface 110 disposed above the upper oil surface 60. The oil pan 30 is attached to the internal combustion engine 10 along an attachment surface, identified by reference numerals 120 and 122 in FIG. 3, which is generally perpendicular to the piston symmetry plane 16. The lowest point 132 of the attachment surface 122 is disposed above the upper oil surface 60 in a preferred embodiment of the present invention. At least one baffle, 151-155, is disposed on an internal surface 160 of the oil pan 30. An oil pick-up conduit 130 is disposed in fluid communication with the quantity of liquid oil below the upper surface 60. The louver structure 74 comprises first, second and third louvers, 81-83, which are spaced apart from each other and the louver opening structure 78 comprises first, second and third louver openings, 91-93. The louver openings are unequal in effective area through which oil droplets can pass. For example, the effective area of the first louver opening 91 is greater than that of the second louver opening 92 and the effective area of the second louver opening 92 is greater than that of the third louver opening 93. The internal wall surface 110 is generally parallel to the piston symmetry plane 16 in a preferred embodiment of the present invention.

Although the present invention has been described in particular detail and illustrated to show a preferred embodiment, it should be understood that alternative embodiments are also within its scope.

We claim:

1. A lubrication system for an engine of a marine vessel, comprising:

an internal combustion engine having all of its cylinders aligned in a single piston symmetry plane, said piston symmetry plane being disposed at a tilt angle from a vertical plane, said tilt angle being between fifteen and seventy five degrees, said engine having a crankshaft disposed within a crankcase and disposed within said piston symmetry and vertical planes;

an oil pan attached to said internal combustion engine, said oil pan and said crankcase defining an internal cavity, said oil pan being shaped to contain a quantity of liquid oil having an upper oil surface; and a windage tray disposed within said internal cavity, said windage tray having a louver structure formed through a surface thereof, said louver structure being formed to define a louver opening structure therethrough, said louver structure being configured to inhibit droplets of said oil from having a direct linear path through said louver opening structure from said crankshaft to said upper oil surface, said oil pan being attached to said internal combustion engine along an attachment surface which is generally perpendicular to said piston symmetry plane, a lowest point of said attachment surface being disposed above said upper oil surface.

2. The system of claim 1, wherein:

said oil pan has a sidewall extending diagonally above said upper oil surface during normal operation of said internal combustion engine;

said louver structure is configured to define a direct path through said louver opening structure from said crankshaft to said sidewall disposed above said upper oil surface.

3. The system of claim 2, wherein:

said sidewall is generally parallel to said piston symmetry plane and disposed at said tilt angle.

4. The system of claim 1, further comprising:

at least one baffle disposed on an internal surface of said oil pan.

5. The system of claim 1, further comprising:

an oil pick-up conduit disposed in fluid communication with said quantity of liquid oil.

6. The system of claim 1, wherein:

said louver structure comprises first and second louvers spaced apart from each other and said louver opening structure comprises first and second louver openings, said first and second louver openings being unequal in effective area.

7. The system of claim 6, wherein:

said first louver opening is larger in said effective area than said second louver opening.

8. A lubrication system for an engine of a marine vessel, comprising:

an internal combustion engine having all of its cylinders aligned in a single piston symmetry plane, said piston symmetry plane being disposed at a tilt angle from a vertical plane, said tilt angle being between fifteen and seventy five degrees, said engine having a crankshaft disposed within a crankcase and disposed within said piston symmetry and vertical planes;

an oil pan attached to said internal combustion engine, said oil pan and said crankcase defining an internal cavity, said oil pan being shaped to contain a quantity of liquid oil having an upper oil surface; and a windage tray disposed within said internal cavity, said windage tray having a louver structure formed through a surface thereof, said louver structure being formed to define a louver opening structure therethrough, said louver structure being configured to inhibit droplets of said oil from having a direct linear path through said louver opening structure from said crankshaft to said upper oil surface, said oil pan having a sidewall disposed above said upper oil surface during normal operation of said internal combustion engine, said oil pan being attached to said internal combustion engine along an attachment surface which is generally perpendicular to said piston symmetry plane, said louver structure being configured to define a direct path through said louver opening structure from said crankshaft to said sidewall disposed above said upper oil surface, a lowest point of said attachment surface is disposed above said upper oil surface.

9. The system of claim 8, further comprising:

at least one baffle disposed on an internal surface of said oil pan.

10. The system of claim 8, further comprising:

an oil pick-up conduit disposed in fluid communication with said quantity of liquid oil.

11. The system of claim 8, wherein:

said louver structure comprises first and second louvers spaced apart from each other and said louver opening structure comprises first and second louver openings, said first and second louver openings being unequal in effective area.

12. The system of claim 11, wherein:

said first louver opening is larger in said effective area than said second louver opening.

13. The system of claim 12, wherein:

said sidewall is generally parallel to said piston symmetry plane and disposed at said tilt angle.

14. A lubrication system for an engine of a marine vessel, comprising:

an internal combustion engine having all of its cylinders aligned in a single piston symmetry plane, said piston symmetry plane being disposed at a tilt angle from a vertical plane, said tilt angle being between fifteen and seventy five degrees, said engine having a crankshaft disposed within a crankcase and disposed within said piston symmetry and vertical planes;

an oil pan attached to said internal combustion engine, said oil pan and said crankcase defining an internal cavity, said oil pan being shaped to contain a quantity of liquid oil having an upper oil surface; and a windage tray disposed within said internal cavity, said windage tray having a louver structure formed through a surface thereof, said louver structure being formed to define a louver opening structure therethrough, said louver structure being configured to inhibit droplets of said oil from having a direct linear path through said louver opening structure from said crankshaft to said upper oil surface, said oil pan having a sidewall disposed above said upper oil surface during normal operation of said internal combustion engine, said louver structure being configured to define a direct path through said louver opening structure from said crankshaft to said sidewall disposed above said upper oil surface, said oil pan being attached to said internal combustion engine along an attachment surface which is generally perpendicular to said piston symmetry plane, a lowest point of said attachment surface being disposed above said upper oil surface.

15. The system of claim 14, further comprising:

at least one baffle disposed on an internal surface of said oil pan; and an oil pick-up conduit disposed in fluid communication with said quantity of liquid oil, said louver structure comprising first and second louvers spaced apart from each other and said louver opening structure comprises first and second louver openings, said first and second louver openings being unequal in effective area, said first louver opening being larger in said effective area than said second louver opening, said sidewall being generally parallel to said piston symmetry plane.

* * * * *